US008366479B2

(12) United States Patent
Borst et al.

(10) Patent No.: US 8,366,479 B2
(45) Date of Patent: Feb. 5, 2013

(54) FEEDER CLAMP

(75) Inventors: Joachim Borst, Donaueschingen (DE); Eduard Betz, Bonndorf (DE); Hermann Stadler, Donaueschingen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 13/242,812

(22) Filed: Sep. 23, 2011

(65) Prior Publication Data

US 2012/0077355 A1 Mar. 29, 2012

(30) Foreign Application Priority Data

Sep. 27, 2010 (DE) ..... 10 2010 046 563

(51) Int. Cl.
*H01R 13/60* (2006.01)

(52) U.S. Cl. ..... 439/567

(58) Field of Classification Search ..... 439/567, 439/814, 811, 704
See application file for complete search history.

(56) References Cited

U.S. PATENT DOCUMENTS

| | | | | |
|---|---|---|---|---|
| 3,717,841 | A | 2/1973 | Mancini | |
| 4,384,757 | A | 5/1983 | Andrews | |
| 5,378,172 | A * | 1/1995 | Roberts | 439/607.26 |
| 7,399,187 | B1 | 7/2008 | Chiang | |
| 8,021,186 | B2 * | 9/2011 | Wang | 439/567 |

FOREIGN PATENT DOCUMENTS

| | | | |
|---|---|---|---|
| AT | 11 469 | E | 7/1981 |
| AT | 24 797 | E | 10/1984 |
| DE | 4038362 | | 4/1992 |
| DE | 10 2008 046 583 | A1 | 9/2008 |
| WO | WO2010/063459 | | 6/2010 |

* cited by examiner

*Primary Examiner* — Phuong Dinh
(74) *Attorney, Agent, or Firm* — Todd L. Juneau

(57) ABSTRACT

The invention relates to an electrical connecting terminal with an insulating connecting terminal housing and one or more clip-on contacts for the conduction of electrical current.

9 Claims, 6 Drawing Sheets

FEEDER CLAMP

The invention relates to a connecting terminal in accordance with the preamble of patent claim 1. There exist connecting terminals that have an insulating connecting terminal housing and at least one clip-on contact that is positioned in the connecting terminal housing for the purpose of connecting an electrical conductor. In this case a contact element, which is connected in an electrically conducting manner to one of the clip-on contacts in the connecting terminal housing, is led through a first opening of the connecting terminal housing to the outside of the connecting terminal housing; and, when the connecting terminal is mounted on the circuit board, said contact element comes into contact with a contact area of the circuit board, in order to produce an electrical contact between a circuit board and the clip-on contact(s). This kind of connecting terminal is disclosed, for example, in the German patent application DE 10 2007 043 197 A1. However, the connecting terminal described there has a contact spring, which presses against a flat contact area that is disposed on the surface of the circuit board. The drawback with such a configuration is that an exact relative positioning between the connecting terminal and the circuit board is not guaranteed. In addition, the spring contacts are not protected against mechanical damage.

DE 33 20 418 A1 discloses connecting terminals that exhibit plug contacts that engage with vias of a circuit board. Although this approach enables a relative positioning between the connecting terminals and the circuit board, the plug contacts do not always guarantee a reliable contact making between the plug contact and the via.

The object of the invention is to provide an inexpensive pluggable connecting terminal that guarantees a reliable contact making with a circuit board.

This engineering object is achieved with the connecting terminal exhibiting the features disclosed in patent claim 1 and a connecting terminal/circuit board arrangement exhibiting the features disclosed in patent claim 8.

Advantageous embodiments and further developments are apparent from the dependent claims.

The inventive connecting terminal with an insulating connecting terminal housing and at least one or at least two clip-on contacts that are positioned in the connecting terminal housing for the purpose of connecting an electrical conductor, wherein a contact element, which is connected in an electrically conducting manner to one of the clip-on contacts or to both clip-on contacts in the connecting terminal housing, is led through a first opening of the connecting terminal housing to the outside of the connecting terminal housing; and, when the connecting terminal is mounted on the circuit board, said contact element comes into contact with a contact area of the circuit board, in order to produce an electrical contact between a circuit board and the clip-on contact(s), is characterized in that the contact area is disposed on the inside of a contact opening of the circuit board; and the contact element has two leaf spring-like spring elements, which are configured so as to extend at least in sections away from each other and then towards each other, wherein the distance between the free ends of the spring elements is less than the diameter of the contact opening, wherein the longest distance between the spring elements is arranged outside the connecting terminal housing; and wherein the longest distance between the spring elements is greater than the diameter of the contact opening. Since the two spring elements are configured in the manner of a leaf spring, a longer spring excursion is possible, because the contact element itself is not elastic, but rather the two leaf spring-like spring elements are springy as a whole, thus guaranteeing in particular a reliable contact between the contact element and the contact area. Since the contact area is disposed on the inside of a contact opening of the circuit board, the connecting terminal with the contact element can be mounted into the contact opening and, in this way, can already produce a relative positioning between the connecting terminal and the circuit board. Since the distance between the free ends of the spring elements is less than the diameter of the contact opening and then the spring elements are configured so as to extend away from each other, the result is a lead chamfer, which allows the leaf spring-like spring elements to be inserted in an easy and simple way into the contact opening. Since the longest distance between the spring elements is arranged outside the connecting terminal housing and is greater than the diameter of the contact opening, the result is a reliable contact-making between the contact element and the contact area on the inside of the contact opening.

Preferably the spring elements are constructed at least in sections as arc segment-like elements that are configured so as to extend in opposite directions, so that the fabrication of these spring elements is especially cost effective.

According to an especially preferred embodiment of the invention, the spring elements in the area of the first opening exhibit a distance that is greater than the diameter of the first opening. As a result, the spring elements are prestressed by the first opening of the connecting terminal housing, a feature that generates a better contact force between the contact element and the contact area.

According to an advantageous embodiment of the invention, the spring elements are configured so as to be curved in the cross section, in order to produce a larger contact area between the leaf spring-like spring elements and the contact area on the inside of the contact opening.

Preferably each contact element has two clip-on contacts in the connecting terminal housing; and each of the spring elements of the contact elements is connected in an electrically conducting manner to precisely one clip-on contact. This strategy allows two electrical conductors to be connected in a simple and easy way to one contact area by means of the two clip-on contacts.

Preferably the interior of the contact opening of the circuit board has two contact areas that are electrically insulated from each other, so that two electrical conductors can be connected so as to be electrically insulated from each other by means of the connecting terminal within a confined space in a contact opening.

Preferably the first opening on the outside of the connecting terminal housing has a rim, which extends around in sections and which protects the free ends of the spring elements that project beyond the first opening, against mechanical damage.

An especially effective protection against mechanical damage of the free ends of the leaf spring-like spring elements is achieved, if a sleeve that is closed on one side is disposed preferably on the outside of the connecting terminal housing adjacent to the first opening. A side wall of this sleeve has two openings, through which the free ends of the spring element and, in particular, the area of the longest distance between the two spring elements are accessible, wherein the sleeve can be inserted into the contact opening. In addition, the sleeve allows the connecting terminal to be positioned relative to the circuit board, especially if the sleeve can be inserted in essence so as to fit precisely into the contact opening.

The connecting terminal/circuit board arrangement comprises a circuit board according to the invention and a connecting terminal with an insulating connecting terminal housing and at least one or at least two clip-on contacts that are positioned in the connecting terminal housing for the purpose of connecting an electrical conductor, wherein a contact element, which is connected in an electrically conducting manner to one of the clip-on contacts or to two clip-on contacts in the connecting terminal housing, is led through a first opening of the connecting terminal housing to the outside of the connecting terminal housing; and, when the connecting terminal is mounted on the circuit board, said contact element comes into contact with a contact area of the circuit board, in order to produce an electrical contact between the circuit board and the clip-on contact(s), wherein the contact area is disposed on the inside of a contact opening of the circuit board; and wherein the contact element has two leaf spring-like spring elements, which are configured so as to extend at least in sections away from each other and then towards each other, wherein the distance between the free ends of the spring elements is less than the diameter of the contact opening, when the connecting terminal is not mounted on the circuit board, and then the spring elements are configured so as to extend away from each other, so that a lead chamfer is formed, wherein the longest distance between the spring elements is arranged outside the connecting terminal housing; and wherein the longest distance between the spring elements is greater than the diameter of the contact opening, when the connecting terminal is not mounted on the circuit board, so that it is possible to produce a reliable contact between the contact element and the contact area on the inside of the contact opening. This means, in particular, that the contact between the spring element and the contact surface of the circuit board is produced preferably at the point of the spring elements, at which the distance between the spring elements in the non-inserted state of the connecting terminal is the longest.

This kind of connecting terminal/circuit board arrangement is characterized by the fact that the geometric configuration of the leaf spring-like spring elements in combination with an internal contact, which is positioned inside a contact opening of a circuit board, makes it possible for this arrangement to provide the possibility of a simple and reliable electrical contact-making with the circuit board by means of the connecting terminal. In the mounted or more specifically inserted state of the connecting terminal, which can be provided especially fast and easily due to the configuration of the spring elements that provide a lead chamfer, the sections of the spring elements, which produce the contact with the internal contact owing to their geometric design, are pressed against the internal contact with the contact pressure provided by the spring action and, as a result, ensure a good electrical contact. Despite the good and reliable contact making, the contact in the connecting terminal/circuit board arrangement according to the invention can be disconnected. The connecting terminal can be easily removed, if desired, and mounted with ease. Thus, it involves a pluggable connecting terminal.

It must also be pointed out that all of the features that are disclosed in connection with a connecting terminal according to the invention may be transferred directly to a connecting terminal that is a component of a connecting terminal/circuit board arrangement according to the invention and, thus, to the same. Therefore, the dependent claims with respect to claim 1 may also be formulated as the dependent claims with respect to claim 8.

The invention is explained in detail below with reference to the figures.

FIG. 5 is a partially cut view of the connecting terminal according to FIG. 3, and.

Figure 4:
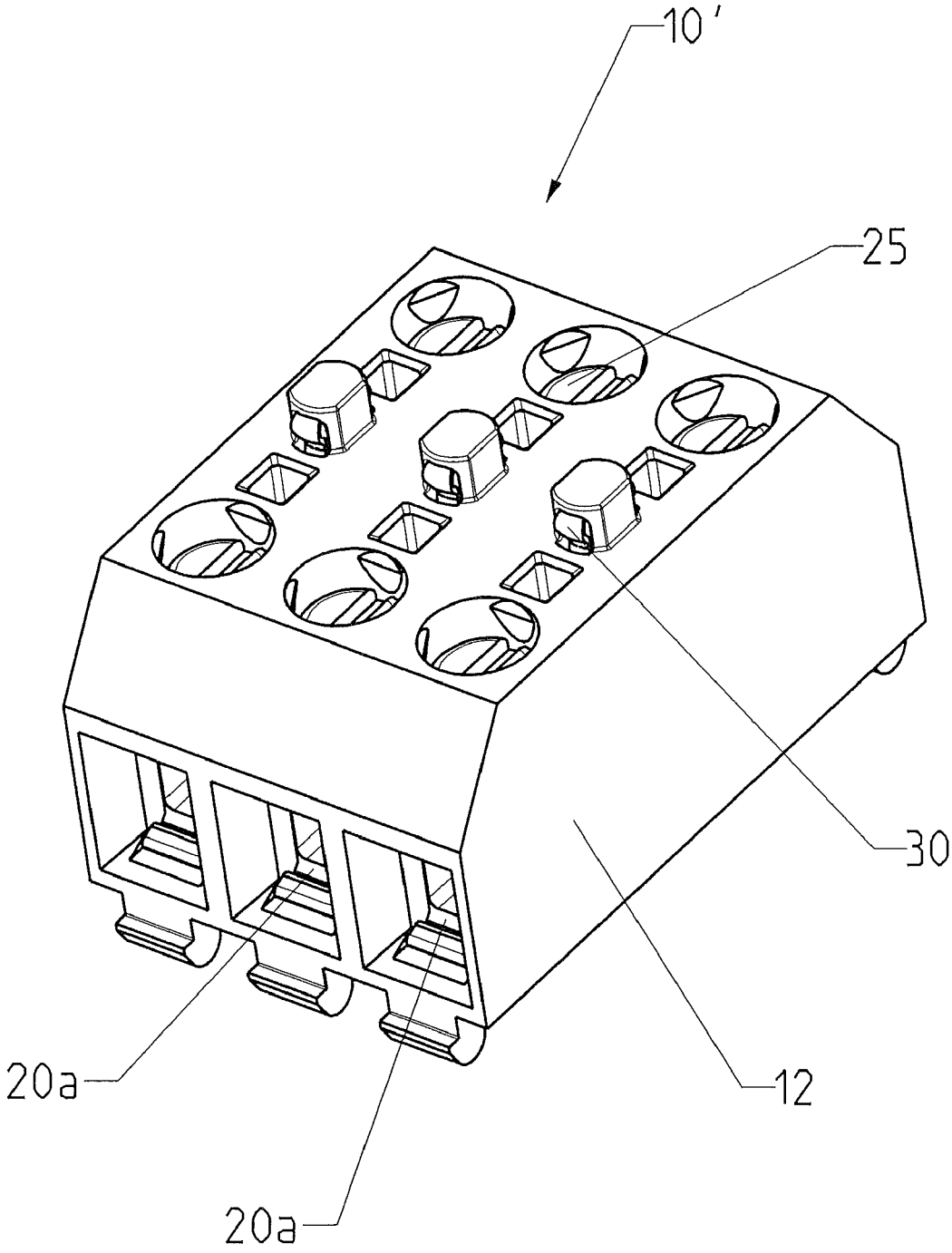
FIG. 4 is a perspective view of a second exemplary embodiment of a connecting terminal according to the invention.
Figure 5:
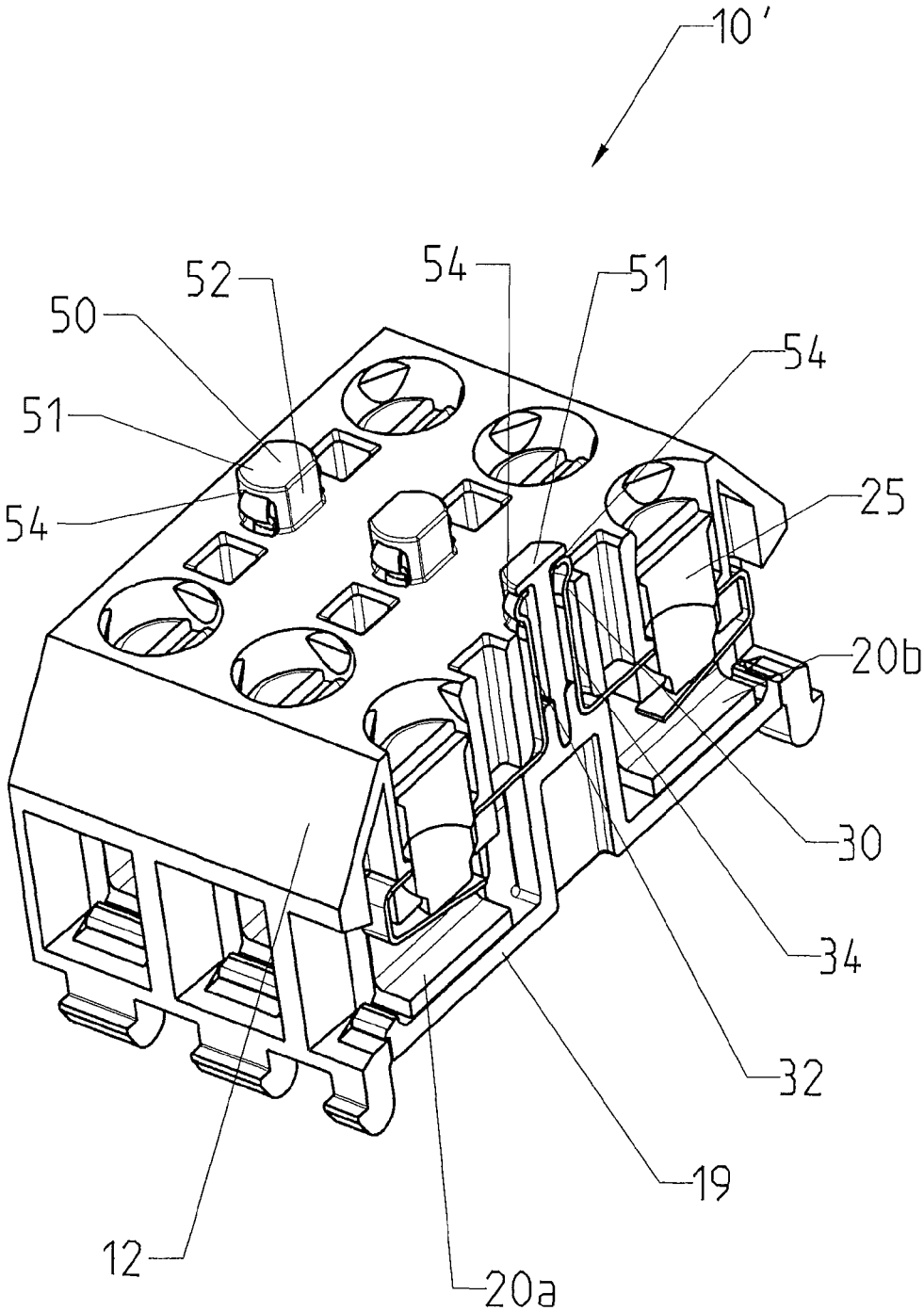
Figure 6A:
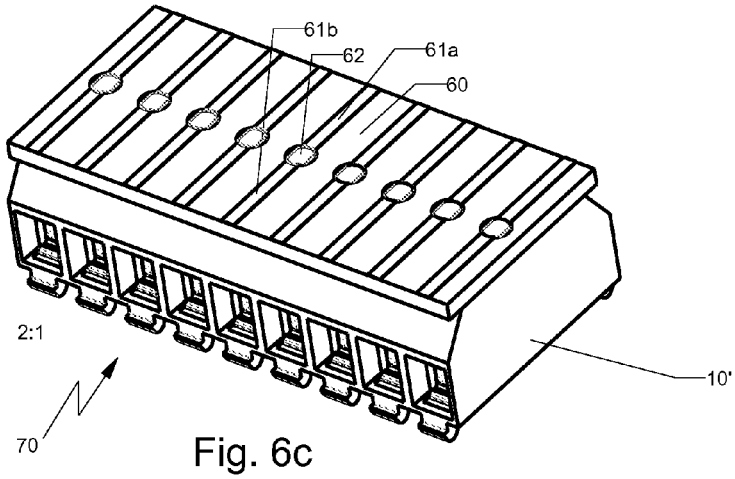

FIG. 6*a* is a three dimensional view of a circuit board/connecting terminal arrangement with a connecting terminal according to FIG. 4.

Figure 6C:
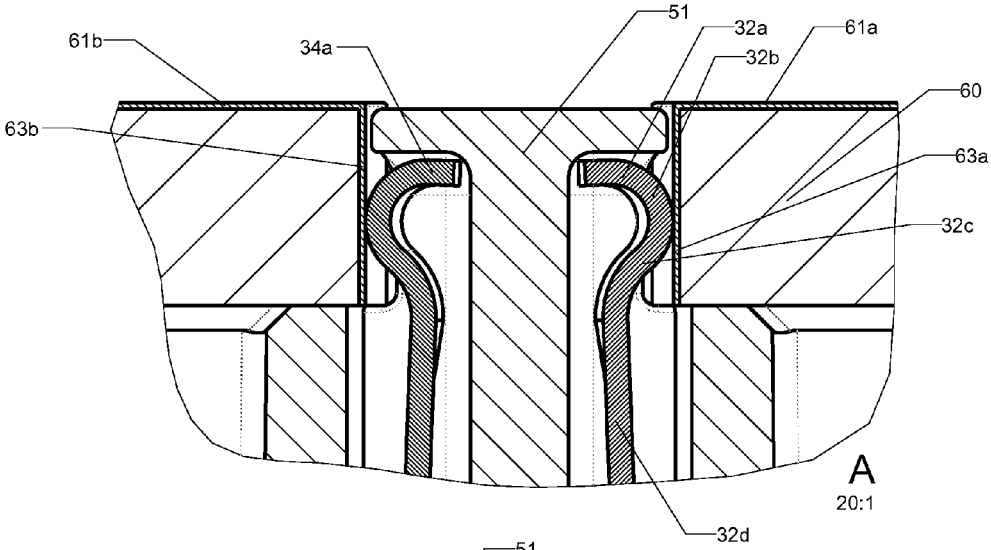
Figure 6B:
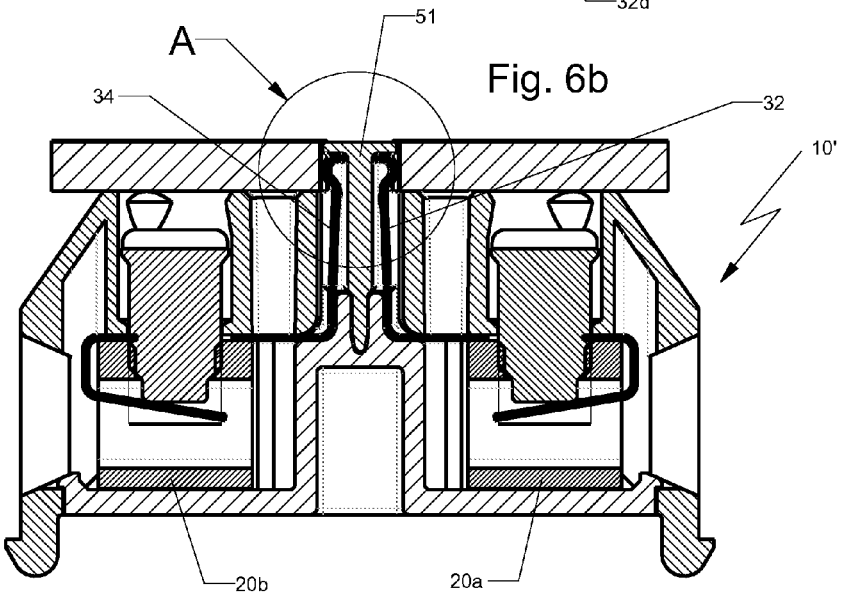

FIG. 6*b* is a longitudinal view of the circuit board/connecting terminal arrangement from FIG. 6*a*.

FIG. 6*c* is a detailed view of the detail A from FIG. 6*b*.

Figure 1:
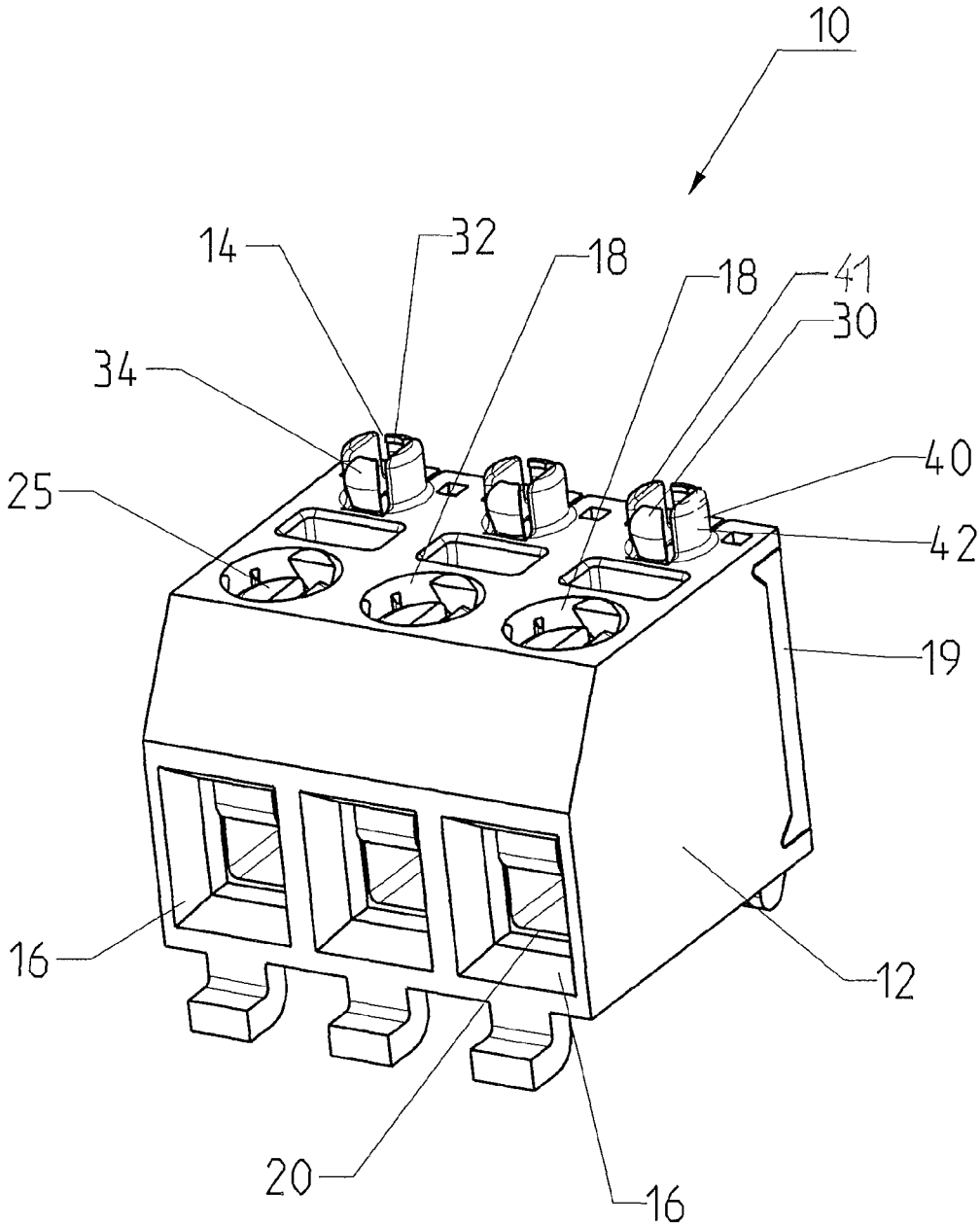
FIG. 1 is a perspective view of a first exemplary embodiment of a connecting terminal according to the invention.
Figure 2:
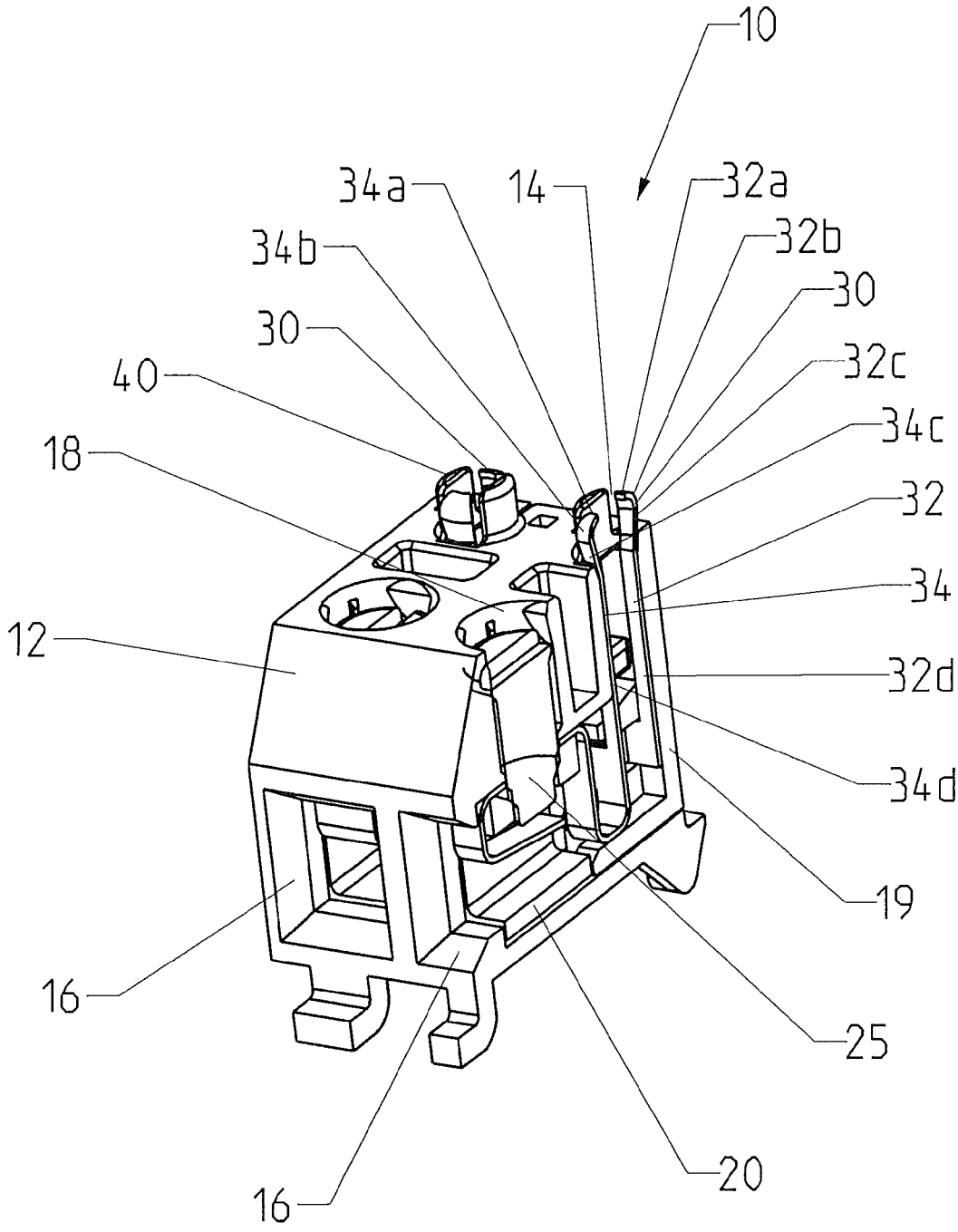
FIG. 2 is a partially cut view of the connecting terminal according to FIG. 1.
Figure 3:
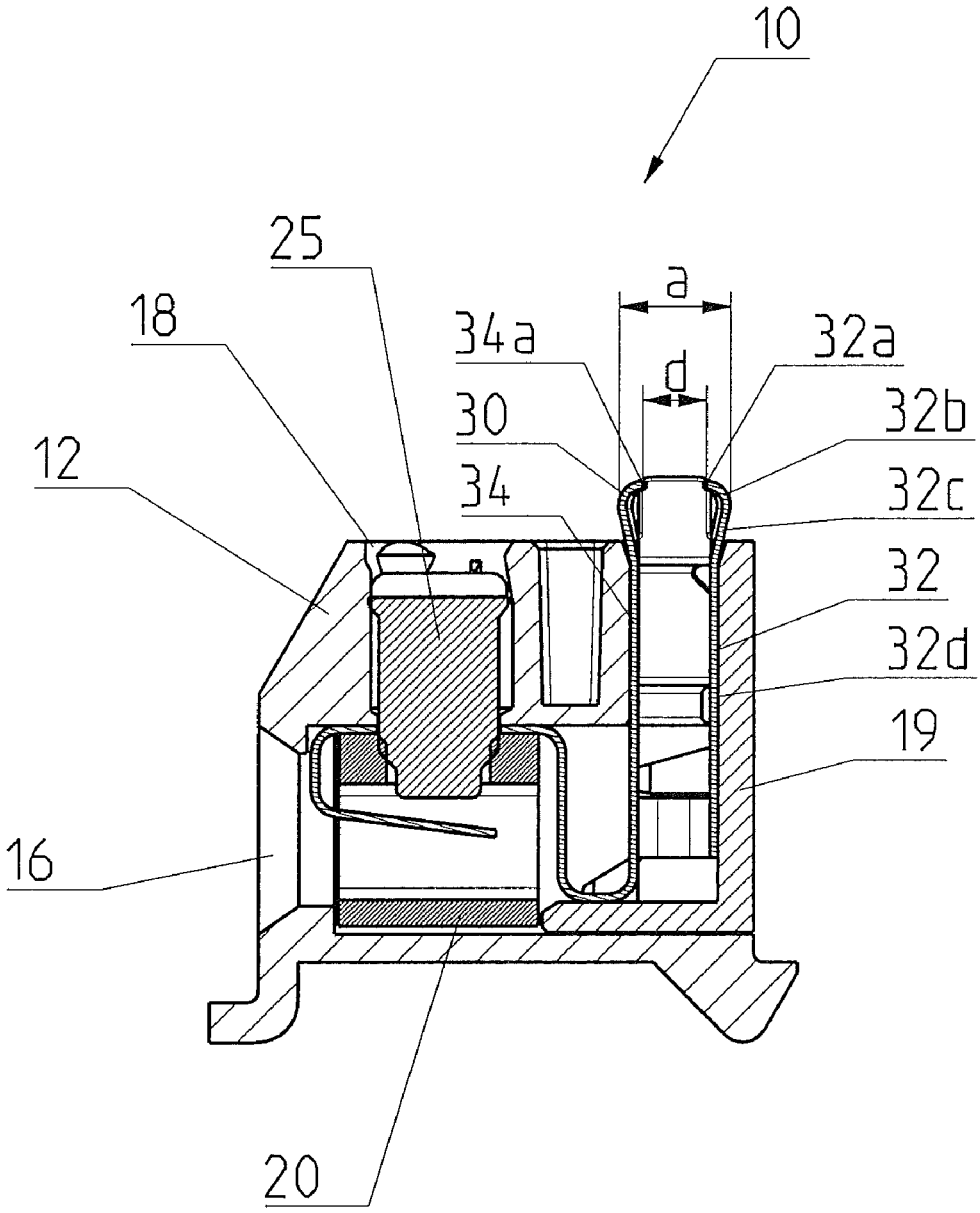
FIG. 3 is a longitudinal view of the connecting terminal according to FIG. 1.

FIGS. 1 to 3 show a first exemplary embodiment of a connecting terminal 10 with a connecting terminal housing 12 made of an insulating material. In this case the connecting terminal housing 12 has a housing cover lid 19 that makes it possible to access the interior of the connecting terminal housing 12 in a simple and easy way. The connecting terminal housing 12 has three clip-on contacts 20 that are designed so as to be in essence identical to each other. It is obvious that more or less clip-on contacts 20, in particular only one clip-on contact 20, can be disposed in the connecting terminal housing 12. The clip-on contacts 20 are configured as screw clip-on contacts. In this case an electrical conductor can be inserted through a second opening 16 into the clip-on contact 20, where said conductor can be fixed in position with a setscrew 25, which can be accessed through a third opening 18 of the connecting terminal housing 12. Instead of a screw contact, it is also possible to use a spring clip-on contact or the like.

The clip-on contact 20 has a contact element 30, which is configured, in particular, in one piece with the clip-on contact 20 and which is formed by a first spring element 32 and a second spring element 34. In this context the two spring elements 32, 34 are configured as leaf spring-like spring elements 32, 34. The two spring elements 32, 34 have a free end 32*a*, 34*a*, which is attached to a first area 32*b*, 34*b*, which is attached to a second area 32*c*, 34*c* and which is attached to a third area 32*d*, 34*d*. The two spring elements 32, 34 run substantially parallel in the third area 32*d*, 34*d* (cf. in particular, FIG. 3). The third area 32*d*, 34*d* of the two spring elements 32, 34 is connected to the contact element 20. Extending from the free end 32*a*, 34*a*, the two spring elements 32, 34 in the first area 32*b*, 34*b* extend away from each other and towards each other in the second area 32*c*, 34*c*. For example, the current figures show that the spring elements 32, 34 in the first area 32*b*, 34*b* and the second area 32*c*, 34*c* are constructed as arc segments that are configured in opposite directions. Between the first area 32*b*, 34*b* and the second area 32*c*, 34*c* the spring elements 32, 34 exhibit the longest distance a, which is arranged on the outside of the first opening 14 outside the connecting terminal housing 12.

The first area 32*b*, 34*b* of the spring elements 32, 34 forms, in particular, a lead chamfer, which simplifies the insertion of the contact element 30 into a contact opening of a circuit board. The longest distance a between the spring elements 32, 34 is greater than the diameter of the contact opening; the distance d between the free ends 32*a*, 34*a* of the spring elements 32, 34 is less than the diameter of the contact opening of the circuit board. This strategy ensures a reliable contact-making of the spring elements 32, 34 in the contact opening of the circuit board. In particular, when the connecting terminal 10 is removed under load from the contact opening of the circuit board, the contact breaking spark is formed in the area of the free end 32*a*, 34*a* of the spring elements 23, 34 and not in the area between the first area 32*b*, 34*b* and the second area 32*c*, 34*c*, which represents the contact area of the spring elements 32, 34 with the contact area of the contact opening of the circuit board, so that any damage to the spring elements 32, 34 that may be caused by the contact breaking spark can be induced in an area of the spring elements 32, 34 that is not required to produce the electrically conducting contact between the clip-on contact 20 and the circuit board. The design of the contact element 30 by means of the two independent spring elements 32, 34 permits a longer spring excursion of the contact element 30 in the contact opening and thus better contact force.

Preferably the spring elements 32, 34 are also configured so as to be curved in the cross section.

The spring elements 32, 34, which project beyond the connecting housing 12, are protected against mechanical damage by means of a rim 40, which extends around in sections and which is disposed on the first opening 14. In this context the rim 40 has a first section 41 and a second section 42, both of which are disposed at the rim of the first opening 14 and border on the spring elements 32, 34 respectively. At the same time the sections 41, 42 of the rim 40 also ensure the exact relative positioning of the connecting terminal 10 in the contact opening of the circuit board.

The FIGS. 4 to 6*c* show a second exemplary embodiment of an inventive connecting terminal 10', where identical reference numerals mark the same or essentially identical parts as in the first exemplary embodiment of the connecting terminal 10; and for the sake of a better understanding not all of the reference numerals are shown in all of the figures.

In the connecting terminal 10 according to the first exemplary embodiment, each contact element 30 has exactly one clip-on contact 20. In this context any number of clip-on contacts 20 with one contact element 20 each can be arranged in the connecting terminal housing 12. The major distinction between the connecting terminal 10' according to the second exemplary embodiment and the first exemplary embodiment of the connecting terminal 10 is, on the one hand, that each contact element 30 has two clip-on contacts 20*a*, 20*b*, wherein the first spring element 32 is connected in an electrically conducting manner to the one clip-on contact 20*a* by means of the third area 32*d* and, in particular, is integrally molded on the said clip-on contact, whereas the second spring element 34 is connected in an electrically conducting manner to the clip-on contact 20*b* by means of the third area 34*d* and, in particular, is integrally molded on the said clip-on contact. This feature allows two electrical conductors to be connected to one contact opening of a circuit board by means of two clip-on contacts 20*a*, 20*b*. In this respect any number of contact elements 30 with two clip-on contacts 20*a*, 20*b* each can be disposed in the connecting terminal housing 12. Of course, in principle, it is also possible to arrange both the contact elements 30, which are connected to only one clip-on contact 20, and the contact elements 30, which are connected to two clip-on contacts 20*a*, 20*b* each, in a connecting terminal housing 12.

The contact opening can have a circumferential contact area, so that the two electrical conductors, which are connected to the clip-on contacts 20*a*, 20*b*, can be maintained at the same electrical potential. However, it is also possible to attach two contact areas, which are electrically insulated from each other, in the contact opening. In this case the first spring element 32 is in electrically conducting contact with the first contact area, and the second spring element 34 is in electrically conducting contact with the second contact area, so that the two electrical conductors, which are connected to the clip-on contacts 20*a*, 20*b*, can be maintained at different electrical potential.

An additional distinction between the second exemplary embodiment of the connecting terminal 10' and the first exemplary embodiment of the connecting terminal 10 lies in the way that the spring elements 32, 34, which are led out of the connecting terminal housing 12, are protected against mechanical damage. According to the second exemplary embodiment of the connecting terminal 10', there is a sleeve 50, which is closed by a cover lid 51 on one side. Said sleeve is mounted on the first opening 14 on the outside of the connecting terminal housing 12. The side wall 52 of said sleeve has two openings 54, which are placed, in particular, diametrically opposite and which provide access to the contact areas of the spring elements 32, 34. The sleeve 50, which can be inserted in essence so as to fit precisely into the contact opening of the circuit board, makes possible a reliable positioning of the connecting terminal 10' in relation to the circuit board.

Of course, it is possible for the connecting terminal 10 according to the first exemplary embodiment of the invention to have a sleeve 50, as in the case of the second exemplary embodiment of the connecting terminal 10', or it is also possible for the first exemplary embodiment of the connecting terminal 10 to have two clip-on contacts 20*a*, 20*b* per contact element 30.

FIGS. 6*a* to 6*c* show a connecting terminal/circuit board arrangement 70 with a connecting terminal according to the second exemplary embodiment of the invention in different graphical renderings or more specifically as an exploded detail that shows clearly how the contact of an inventive connecting terminal with a circuit board is produced.

FIG. 6*a* shows an exemplary connecting terminal/circuit board arrangement 70 comprising a circuit board 60 with conducting tracks 61, which are interrupted in each case by contact openings 62 arranged in the circuit board 60. Mounted on the circuit board 60 is a connecting terminal 10' according to the second embodiment of the invention, as shown in the FIGS. 4 and 5 in the non-inserted state and described above, so that the cover lids 51 can be seen through the contact openings 62.

It is especially clear from the detailed view in FIG. 6*c* showing the area A of the sectional view from FIG. 6*b* that the contact openings 62 of the circuit board 60 have in each case internal contacts 63*a* and 63*b*, which are connected in an electrically conducting manner to the associated sections 61*a* or 61*b* respectively of a conducting track 61. Thus, the contact area formed by the internal contacts 63*a* and 63*b* is arranged inside the contact opening 62—more specifically on its inner rim.

Owing to the insertion of the connecting terminal 10', which is facilitated by the fact that the first area 32*b*, 34*b* of the spring elements 32, 34 forms a lead chamfer, the spring elements 32, 34, whose longest distance in the non-inserted state (depicted in FIGS. 4 and 5) or rather in the unmounted state on the circuit board 60 is greater than the diameter of the contact opening 62, is compressed and under mechanical stress. In other words, in the inserted state the distances a and d are diminished. This feature guarantees a reliable contact-making of the spring elements 32, 34 in relation to the internal contacts 63*a*, 63*b* in the contact opening 62 of the circuit board 60.

In this case the contact is established, in particular, at and in the immediate environment of the transition point between the first area 32*b*, 34*b* and the second area 32*c*, 34*c*—thus, approximately at the point, at which in the non-inserted state of the connecting terminal 10' the spring elements 32, 34 are spaced the furthest apart from each other.

It is immediately clear from a comparison of FIG. 6*b* with FIG. 3, in particular, the respective ends 32*a*, 34*a* and the areas 32*b*, 32*c* and 34*b*, 34*c* of the spring elements 32, 34 that a circuit board/connecting terminal arrangement with a reliable electrical contact-making between the spring elements 32, 34 and an internal contact 63*a*, 63*b* of the circuit board 60 by simply inserting the connecting terminal 10 according to the first exemplary embodiment of the invention can be produced in exactly the same way as shown in FIGS. 6*a* to 6*c* for a connecting terminal 10' according to the second exemplary embodiment of the invention. The configuration of the electrical contact to the internal contact 63*a*, 63*b* that was discussed above by way of the example of the second embodiment is determined by the shaping of the spring elements 32, 34 in the areas 32*b*, 32*c* or 34*b*, 34*c* respectively and the distance between these areas and is, thus, independent of the differences between the connecting terminals 10 and 10'.

Therefore, both the connecting terminal 10 according to the first embodiment of the invention and also the connecting terminal 10' according to the second embodiment of the invention concern pluggable connecting terminals 10, 10', which can be mounted on a circuit board 60 and can be removed again and where, in particular, the electrical contact does not have to be produced by soldering to the circuit board 60.

List of Reference Numerals

10 connecting terminal
10' connecting terminal
12 connecting terminal housing
14 first opening
16 second opening
18 third opening
19 housing cover lid
20 clip-on contact
20*a* clip-on contact
20*b* clip-on contact
25 setscrew
30 contact element
32 first spring element
32*a* free end
32*b* first area
32*c* second area
32*d* third area
34 second spring element
34*a* free end
34*b* first area
34*c* second area
34*d* third area
40 rim
41 first section
42 second section
50 sleeve
51 cover lid
52 side wall
54 opening
a distance
d distance
60 circuit board
61*a* conducting track
61*b* conducting track
62 contact opening
63*a* internal contact
63*b* internal contact
70 connecting terminal/circuit board arrangement We hereby claim:

1. A connecting terminal comprising an insulating connecting terminal housing and at least one clip-on contact, such contact(s) positioned in the connecting terminal housing for the purpose of connecting an electrical conductor, wherein a contact element, which is connected in an electrically conducting manner to one or more of the clip-on contacts in the connecting terminal housing are led through a first opening of the connecting terminal housing to the outside of the connecting terminal housing; and, when the connecting terminal is mounted on the circuit board, said contact element comes into contact with a contact area of the circuit board, in order to produce an electrical contact between a circuit board and the one or more clip-on contacts, further comprising wherein the contact element has two leaf spring-like spring elements, which lend themselves well to making contact with a contact area, which is disposed on the inside of a contact opening of the circuit board and which are configured so as to extend at least in sections away from each other and then towards each other, wherein the distance between the free ends of the spring elements is less than the diameter of the contact opening, and then the spring elements are configured so as to extend away from each other, so that a lead chamfer is formed, wherein the longest distance between the spring elements is arranged outside the connecting terminal housing; and wherein the longest distance (a) between the spring elements is greater than the diameter of the contact opening, so that it is possible to produce a reliable contact between the contact element and the contact area on the inside of the contact opening.

2. The connecting terminal of claim 1, further comprising wherein the spring elements are constructed at least in sections as arc segment-like elements that are configured so as to extend in opposite directions.

3. The connecting terminal of claim 1, further comprising wherein the spring elements in the area of the first opening exhibit a distance that is greater than the diameter of the first opening.

4. The connecting terminal of claim 1, further comprising wherein the spring elements are configured so as to be curved in the cross section.

5. The connecting terminal of claim 1, further comprising wherein at least two clip-on contacts are arranged in the connecting terminal housing and each of the spring elements is connected in an electrically conducting manner to precisely one clip-on contact.

6. The connecting terminal of claim 1, further comprising wherein the first opening on the outside of the connecting terminal housing has a rim which extends around in sections.

7. The connecting terminal of claim 1, further comprising wherein a sleeve that is closed on one side is disposed on the outside of the connecting terminal housing adjacent to the first opening, and said sleeve has a side wall with two openings through which the free ends of the spring elements and, in particular, the area of the longest distance between the two spring elements, can be accessed, wherein the sleeve can be inserted into the contact opening.

8. A connecting terminal/circuit board arrangement comprising a circuit board and a connecting terminal with an insulating connecting terminal housing and at least one clip-on contact(s) that are positioned in the connecting terminal housing for the purpose of connecting an electrical conductor, wherein a contact element, which is connected in an electrically conducting manner to one or more of the clip-on contacts in the connecting terminal housing is led through a first opening of the connecting terminal housing to the outside of the connecting terminal housing; and, when the connecting terminal is mounted on the circuit board, said contact element comes into contact with a contact area of the circuit boar, in order to produce an electrical contact between the circuit board and the clip-on contact or the clip-on contacts, further comprising wherein the contact area is disposed on the inside of a contact opening of the circuit board; and that the contact element has two leaf spring-like spring elements, which are configured so as to extend at least in sections away from each other and then towards each other, wherein the distance between the free ends of the spring elements is less than the diameter of the contact opening, when the connecting terminal is not mounted on the circuit board, and then the spring elements are configured so as to extend away from each other, so that a lead chamfer is formed, wherein the longest distance between the spring elements is arranged outside the connecting terminal housing; and wherein the longest distance between the spring elements is greater than the diameter of the contact opening, when the connecting terminal is not mounted on the circuit board, so that it is possible to produce a reliable contact between the contact element and the contact area on the inside of the contact opening.

9. The connecting terminal/circuit board arrangement of claim 8, further comprising wherein the interior of the contact opening of the circuit board has two contact areas that are electrically insulated from each other.

* * * * *